US011560889B1

(12) United States Patent
Smerud

(10) Patent No.: US 11,560,889 B1
(45) Date of Patent: Jan. 24, 2023

(54) SCROLL COMPRESSOR WITH SECOND INTERMEDIATE CAP TO FACILITATE REFRIGERANT INJECTION

(71) Applicant: TRANE INTERNATIONAL INC., Davidson, NC (US)

(72) Inventor: Scott J. Smerud, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 17/364,332

(22) Filed: Jun. 30, 2021

(51) Int. Cl.

| | |
|---|---|
| ***F04C 2/02*** | (2006.01) |
| ***F04C 15/00*** | (2006.01) |
| ***F04C 29/12*** | (2006.01) |
| ***F04C 18/02*** | (2006.01) |
| ***F04C 27/00*** | (2006.01) |
| ***F04C 29/00*** | (2006.01) |

(52) U.S. Cl.
CPC ..... *F04C 2/025* (2013.01); *F04C 15/0007* (2013.01); *F04C 18/0215* (2013.01); *F04C 18/0261* (2013.01); *F04C 27/001* (2013.01); *F04C 29/0014* (2013.01); *F04C 29/12* (2013.01); *F04C 2240/30* (2013.01)

(58) Field of Classification Search
CPC ..... F04C 2/025; F04C 18/0215–0292; F04C 15/06–068; F04C 29/0007–0014; F04C 29/12–128; F04C 2240/30; F01C 1/0215–0292; F01C 21/001–002; F01C 21/18–186
See application file for complete search history.

(56) References Cited

U.S. PATENT DOCUMENTS

| | | | | |
|---|---|---|---|---|
| 6,053,715 | A * | 4/2000 | Hirano | F04C 29/0014 418/55.6 |
| 6,474,087 | B1 | 11/2002 | Lifson | |
| 6,773,242 | B1 | 8/2004 | Perevozchikov | |
| 7,100,386 | B2 | 9/2006 | Lifson | |
| 7,201,567 | B2 | 4/2007 | Wiertz et al. | |

(Continued)

FOREIGN PATENT DOCUMENTS

| | | | |
|---|---|---|---|
| CN | 2503231 | Y | 7/2002 |
| CN | 203201801 | U | 9/2013 |
| JP | 2017-101592 | A | 6/2017 |

*Primary Examiner* — Laert Dounis
(74) *Attorney, Agent, or Firm* — Hamre, Schumann, Mueller & Larson, P.C.

(57) ABSTRACT

A scroll compressor includes a compressor housing, an orbiting scroll member and non-orbiting scroll member intermeshed to form a compression chamber, a discharge pressure chamber, an intermediate pressure chamber. The housing includes a lower portion, a first intermediate cap, a second intermediate cap, and an upper portion. The discharge pressure chamber configured to receiving a discharge pressure fluid from the compression chamber. The intermediate pressure chamber fluidly connecting an intermediate pressure fluid inlet port and an intermediate pressure fluid injection port of the non-orbiting scroll member. A method injecting an intermediate pressure fluid into a compression chamber of a scroll compressor includes disposing the intermediate pressure fluid in an intermediate pressure chamber. The method also includes injecting the intermediate pressure fluid in the intermediate pressure chamber through the intermediate pressure fluid injection port into the compression chamber.

20 Claims, 6 Drawing Sheets

(56) References Cited

U.S. PATENT DOCUMENTS

| | | | | |
|---|---|---|---|---|
| 7,674,098 | B2 * | 3/2010 | Lifson | F04C 28/26 417/310 |
| 7,815,423 | B2 * | 10/2010 | Guo | F04C 29/042 418/55.1 |
| 7,854,137 | B2 | 12/2010 | Lifson et al. | |
| 8,303,279 | B2 | 11/2012 | Hahn | |
| 9,239,054 | B2 | 1/2016 | Ignatiev et al. | |
| 2004/0096338 | A1 * | 5/2004 | Cheon | F04C 23/008 417/312 |
| 2004/0184932 | A1 * | 9/2004 | Lifson | F04C 29/042 417/310 |
| 2006/0228243 | A1 | 10/2006 | Sun et al. | |
| 2007/0237664 | A1 * | 10/2007 | Joo | F04C 29/126 418/55.1 |
| 2020/0408209 | A1 * | 12/2020 | Lepak | F04C 23/008 |
| 2022/0034324 | A1 * | 2/2022 | Lee | F04C 29/12 |

* cited by examiner

SCROLL COMPRESSOR WITH SECOND INTERMEDIATE CAP TO FACILITATE REFRIGERANT INJECTION

FIELD

This disclosure generally relates to a scroll compressor. More specifically, this disclosure relates to providing an intermediate pressure fluid into a scroll compressor in a heating, ventilation, air conditioning, and refrigeration (HVACR) system.

BACKGROUND

A heating, ventilation, air conditioning, and refrigeration (HVACR) system generally includes a compressor, such as a scroll compressor. Scroll compressors include a pair of scroll members which orbit relative to each other to compress a working fluid, such as for example, a refrigerant. The compressor compresses a working fluid (e.g., refrigerant, or the like) at a lower pressure and discharges the fluid at a higher pressure. An intermediate pressure fluid can be introduced to the compressor at an intermediate pressure to increase compressor capacity.

SUMMARY

This disclosure relates generally to a scroll compressor. More specifically, this disclosure relates to providing intermediate pressure fluid into a scroll compressor in a heating, ventilation, air conditioning, and refrigeration (HVACR) system.

According to an embodiment, a scroll compressor includes a compressor housing including a lower portion, a first intermediate cap, a second intermediate cap, and an upper portion. An orbiting scroll member and a non-orbiting scroll member are disposed within the compressor housing and intermeshing forming a compression chamber. A discharge pressure chamber is disposed between the second intermediate cap and the upper portion configured to receive a discharge pressure fluid from the compression chamber through a compression chamber discharge port. An intermediate pressure chamber is disposed between the first intermediate cap and the second intermediate cap fluidly connecting an intermediate pressure fluid inlet and an intermediate pressure fluid injection port of the non-orbiting scroll member. A face seal is disposed between an upper surface of the non-orbiting scroll member and a lower surface of the first intermediate cap.

In an embodiment, the compressor further includes a radial seal disposed between an inner radial wall of the second intermediate cap and an outer sidewall of the compression chamber discharge port.

In an embodiment, a seal is formed between the intermediate pressure chamber and the discharge pressure chamber without a face seal.

In an embodiment, the second intermediate cap radially extends from an outer sidewall of the compression chamber discharge port and attaches to an outer sidewall of the first intermediate cap.

In an embodiment, the intermediate pressure fluid inlet is disposed on a sidewall of the second intermediate cap and is configured to receive an intermediate pressure fluid into the intermediate pressure chamber.

In an embodiment, the compressor includes a compressor outlet disposed on a sidewall of the upper portion.

In an embodiment, the intermediate pressure fluid injection port is disposed in the non-orbiting scroll member and is configured to inject an intermediate pressure fluid from the intermediate pressure chamber into the compression chamber.

In an embodiment, the intermediate pressure fluid injection port is configured to fluidly connect to the compression chamber at a location wherein a fluid being compressed is between a suction pressure and a discharge pressure of the compressor.

In an embodiment, the compression chamber is configured to receive a suction pressure fluid from a compressor inlet, receive an intermediate pressure fluid at an intermediate pressure, compress the suction pressure fluid and the intermediate pressure fluid to a discharge pressure providing the discharge pressure fluid, and discharge the discharge pressure fluid to the discharge pressure chamber.

In an embodiment, the discharge pressure chamber fluidly connects the compression chamber discharge port to a compressor outlet.

According to an embodiment, a method of injecting an intermediate pressure fluid into a compression chamber of a scroll compressor, the scroll compressor including a housing having a lower portion, a first intermediate cap, a second intermediate cap, and an upper portion. The method includes receiving the intermediate pressure fluid by an intermediate pressure fluid inlet and disposing the intermediate pressure fluid in an intermediate pressure chamber between the first intermediate cap and the second intermediate cap, wherein the intermediate pressure chamber fluidly connects the intermediate pressure fluid inlet and an intermediate pressure fluid injection port of the non-orbiting scroll member. The method includes injecting the intermediate pressure fluid in the intermediate pressure chamber through the intermediate pressure fluid injection port into a compression chamber at a location wherein a fluid being compressed is between a suction pressure and a discharge pressure. The method includes compressing the intermediate pressure fluid in the compression chamber to provide a discharge pressure fluid, the compression chamber formed by intermeshing an orbiting scroll member and a non-orbiting scroll member disposed within the compressor housing. The method includes discharging the discharge pressure fluid at the discharge pressure from the compression chamber through a compression chamber discharge port to a discharge pressure chamber, the discharge pressure chamber disposed between the second intermediate cap and the upper portion of the housing.

In an embodiment, the method includes receiving the intermediate pressure fluid by the intermediate pressure fluid inlet through a sidewall of the second intermediate cap.

In an embodiment, the method includes discharging the discharge pressure fluid in the discharge pressure chamber through a compressor outlet disposed on a sidewall of the upper portion of the housing.

In an embodiment, the discharge pressure chamber fluidly connects the compression chamber discharge port to the compressor outlet.

In an embodiment, the scroll compressor further includes a radial seal disposed between an inner radial wall of the second intermediate cap and an outer sidewall of the compression chamber discharge port.

In an embodiment, the scroll compressor further includes a face seal disposed between an upper surface of the non-orbiting scroll member and a lower surface of the first intermediate cap.

In an embodiment, a seal is formed between the intermediate pressure chamber and the discharge pressure chamber without a face seal.

In an embodiment, the second intermediate cap radially extends from an outer sidewall of the compression chamber discharge port and attaches to an outer sidewall of the first intermediate cap.

In an embodiment, the intermediate pressure fluid injection port is disposed in the non-orbiting scroll member.

BRIEF DESCRIPTION OF THE DRAWINGS

References are made to the accompanying drawings that form a part of this disclosure, and which illustrate embodiments in which the systems and methods described in this Specification can be practiced.

Like reference numbers represent like parts throughout.

DETAILED DESCRIPTION

This disclosure generally relates to a scroll compressor. More specifically, this disclosure relates to providing intermediate pressure fluid into a scroll compressor in a heating, ventilation, air conditioning, and refrigeration (HVACR) system.

Figure 1A:
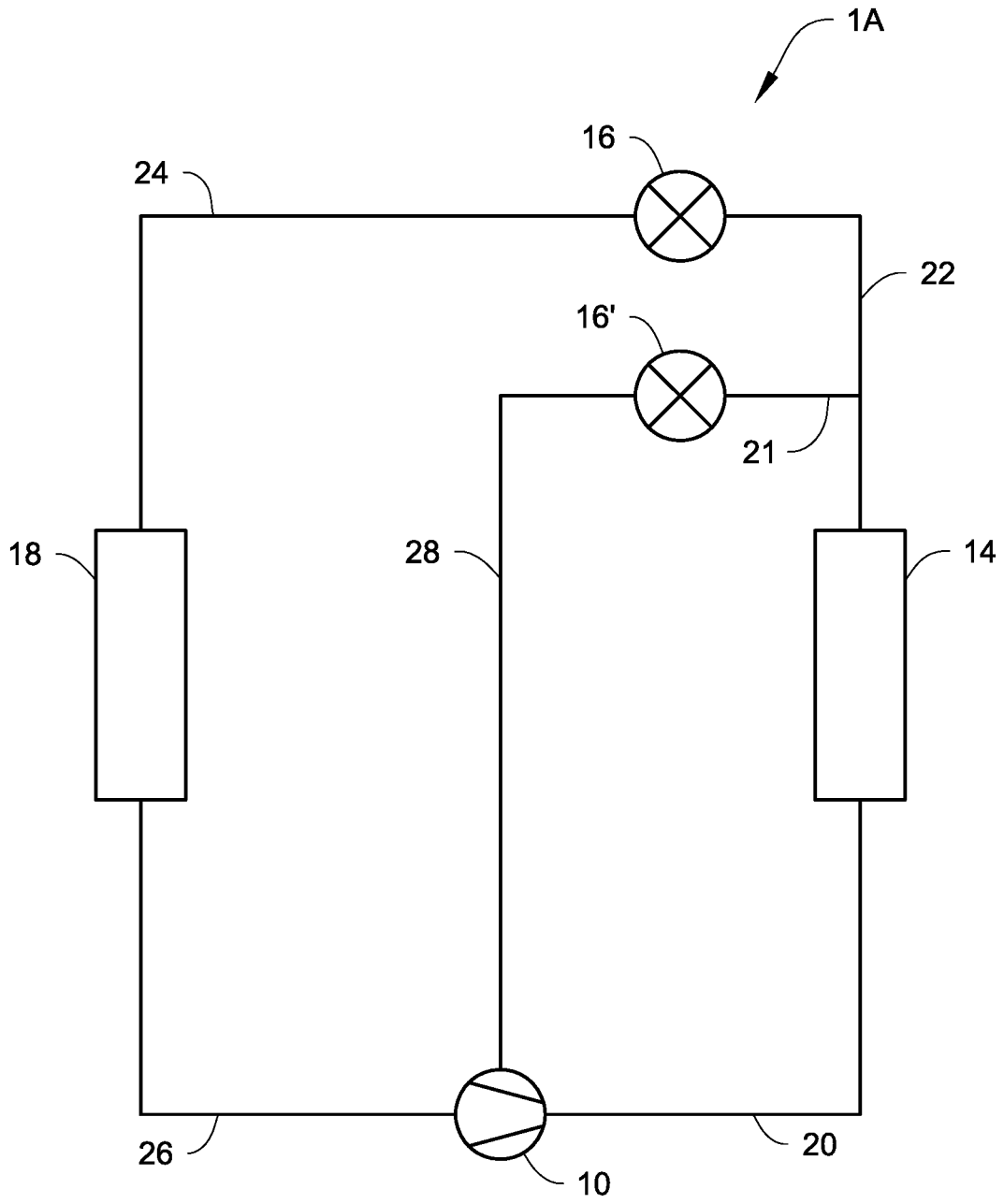
FIG. 1A is a schematic diagram of a refrigerant circuit, according to an embodiment.
Figure 1B:
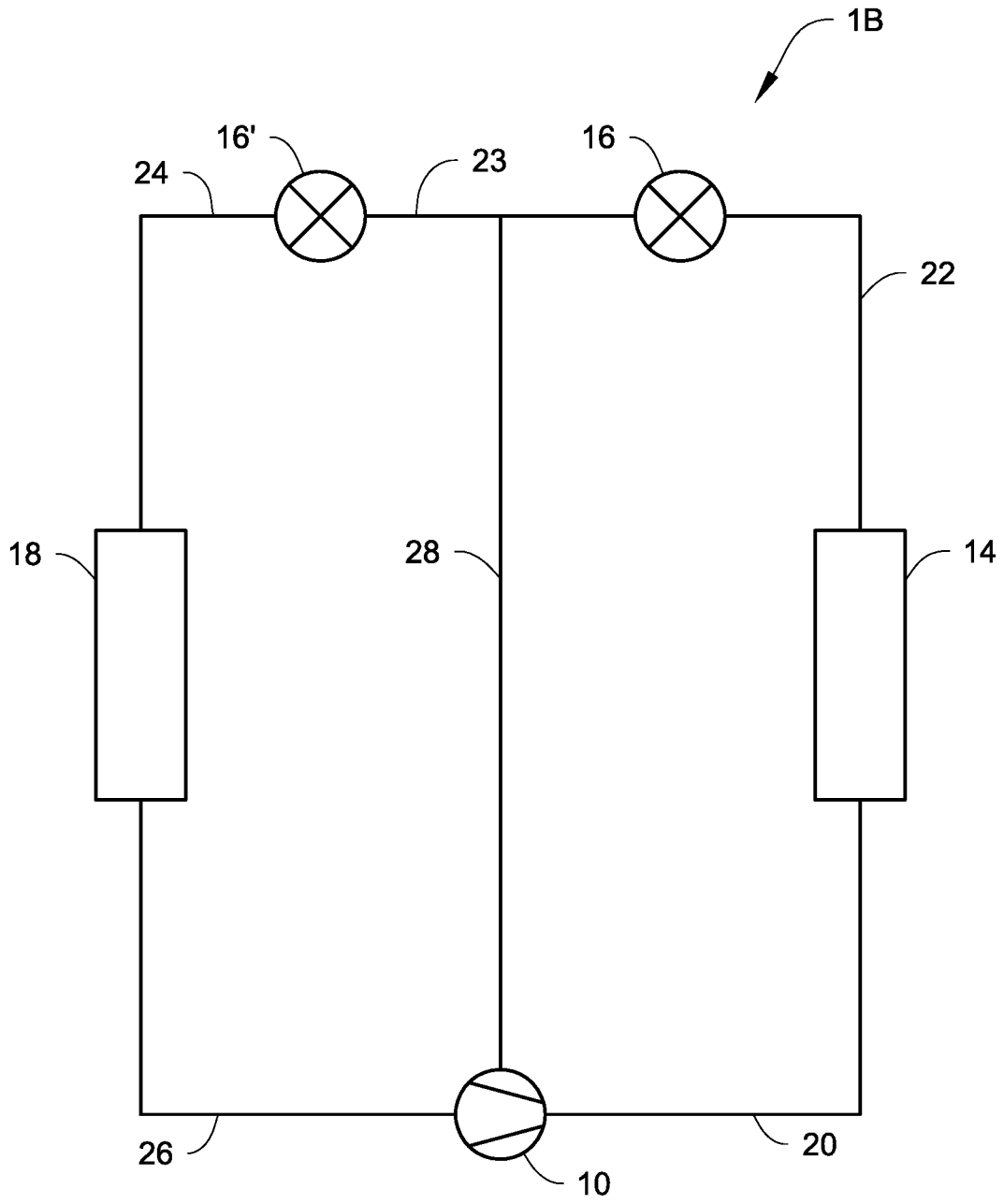
FIG. 1B is a schematic diagram of a refrigerant circuit, according to an embodiment.
Figure 1C:
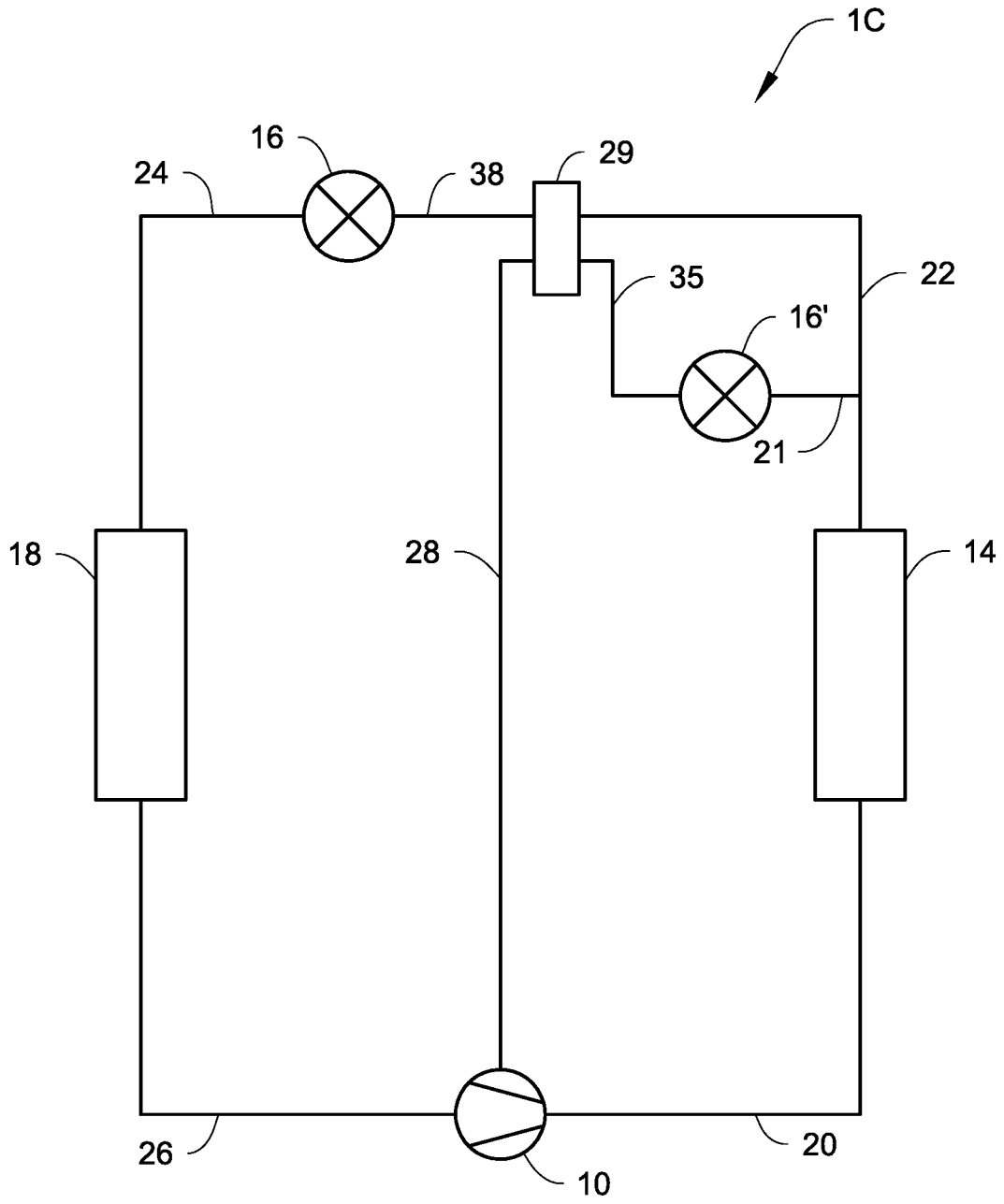
FIG. 1C is a schematic diagram of a refrigerant circuit, according to an embodiment.

FIGS. 1A-1C are schematic diagrams of refrigerant circuits 1A-1C, according to an embodiment. The refrigerant circuits 1A-1C generally includes a compressor 10, a condenser 14, a first expander 16, a second expander 16', and an evaporator 18.

The refrigerant circuits 1A-1C are an example and can be modified to include additional components. For example, in an embodiment, the refrigerant circuits 1A-1C can include other components such as, but and not limited to, one or more flow control devices, economizers, receiver tanks, dryers, suction-liquid heat exchangers, or the like. In an embodiment, the refrigerant circuits 1A-1C can be configured to be a cooling system (e.g., an air conditioning system) capable of operating in a cooling mode. In an embodiment, the refrigerant circuits 1A-1C can be configured to be a heat pump system that can operate in both a cooling mode and a heating/defrost mode. In an embodiment, a refrigerant circuit 1A-1C may be modified to have a single expansion device instead of two.

The refrigerant circuits 1A-1C can be applied in a variety of systems used to control one or more environmental condition (e.g., temperature, humidity, air quality, or the like) in a space (generally referred to as a conditioned space). Examples of such systems include, but are not limited to, HVACR systems, transport refrigeration systems, or the like. Examples of a conditioned space include, but and not limited to, a portion of a home, building, an environmentally controlled container on a vehicle, ship, or vessel, or the like.

As shown in in FIG. 1A, the refrigerant circuit 1A includes, the compressor 10, the condenser 14, the first expander 16, the second expander 16', and the evaporator 18 are fluidly connected via refrigerant lines 20, 21, 22, 23, 24, 26, 35, and 38. In an embodiment, the refrigerant lines 20, 21, 22, 23, 24, 26, 35, and 38 can alternatively be referred to as the refrigerant conduits 20, 21, 22, 23, 24, 26, 35, and 38

In operation, the compressor 10 compresses a working fluid (e.g., a heat transfer fluid such as a refrigerant, refrigerant mixture, or the like) from a relatively lower pressure gas (e.g., suction pressure) to a relatively higher-pressure gas (e.g., discharge pressure). In an embodiment, the compressor 10 can be a positive displacement compressor. For example, the compressor 10 can be a screw compressor, a scroll compressor, a reciprocating compressor, or the like.

The relatively higher-pressure gas discharged from the compressor 10 is also at a relatively higher temperature and flows from the compressor 10 through refrigerant line 20 to the condenser 14. The working fluid flows through the condenser 14 and rejects heat to a first process fluid (e.g., water, air, etc.). The cooled working fluid, which is now liquid or mostly liquid, flows to the first expander 16 via the refrigerant line 22. The first expander 16 allows the working fluid to expand and reduces the pressure of the working fluid. In an embodiment, the expander may be an expansion valve, expansion plate, expansion vessel, orifice, or the like, or other such types of expansion mechanisms. It is to be appreciated that the expander may be any type of expander used in the field for expanding a working fluid to cause the working fluid to decrease in temperature. The gaseous/liquid working fluid has a lower temperature after being expanded by the first expander 16.

This reduced pressure can be at an intermediate pressure that is higher than the suction pressure but lower than the discharge pressure of the compressor 10. As a result, the working fluid discharged from the first expander 16 can be in a liquid form, a gaseous form, or a combination thereof. The working fluid discharged from the first expander 16 flows to the evaporator 18 and absorbs heat from a second process fluid (e.g., water, air, etc.), heating the working fluid, and converts the working fluid to a gaseous or a mostly gaseous form. The gaseous working fluid then returns to the compressor 10 via the refrigerant line 26.

A portion of the cooled working fluid from the condenser 14 can flow to the second expander 16' via 21. After passing through the second expander 16', the portion of the cooled working fluid can flow to the compressor 10 via a refrigerant line 28. This portion can be fed into the compressor 10 at an intermediate pressure fluid inlet to be injected to a location of the compression chamber of the compressor wherein the fluid being compressed is suitable for receiving a fluid at the intermediate pressure. The above-described process continues while the refrigerant circuit 1 is operating, for example, in a cooling mode (e.g., while the compressor 10 is in operation).

As shown in FIG. 1B, the second expander 16' can be alternatively disposed between the expander 16 and the evaporator 18. In the illustrated embodiment, the cooled working fluid from the condenser 14 can flow to the expander 16. After the expander 16 and before the second expander 16', a portion of the working fluid can be fed into the compressor 10 at an intermediate pressure. The remaining portion of the cooled working fluid can flow to the second expander 16' via the refrigerant line 23.

As shown in FIG. 1C, the refrigerant circuit 1A can further include a heat exchanger 29 after the second expander 16'. The heat exchanger 29 exchanges energy between the working fluid expanded in the second expander 16' and the remaining portion of the cooled working fluid from the condenser 14 provided by the refrigerant line 22. The working fluid passes the second expander 16' and enters into the heat exchanger 29 via the refrigerant line 35. The working fluid is expanded by the expander 16' and exchanges heat in the heat exchanger 29 with the portion of the working fluid from the refrigerant line 22, cooling the working fluid from the refrigerant line 22. The working fluid from the refrigerant line 22 is cooled in the heat exchanger 29 before being provided to the first expander 16 via the refrigerant line 38. By cooling the portion of the working fluid using the heat exchanger 29, the overall capacity of the refrigerant circuit 1C is increased without increasing the capacity of the compressor 10.

Figure 2:
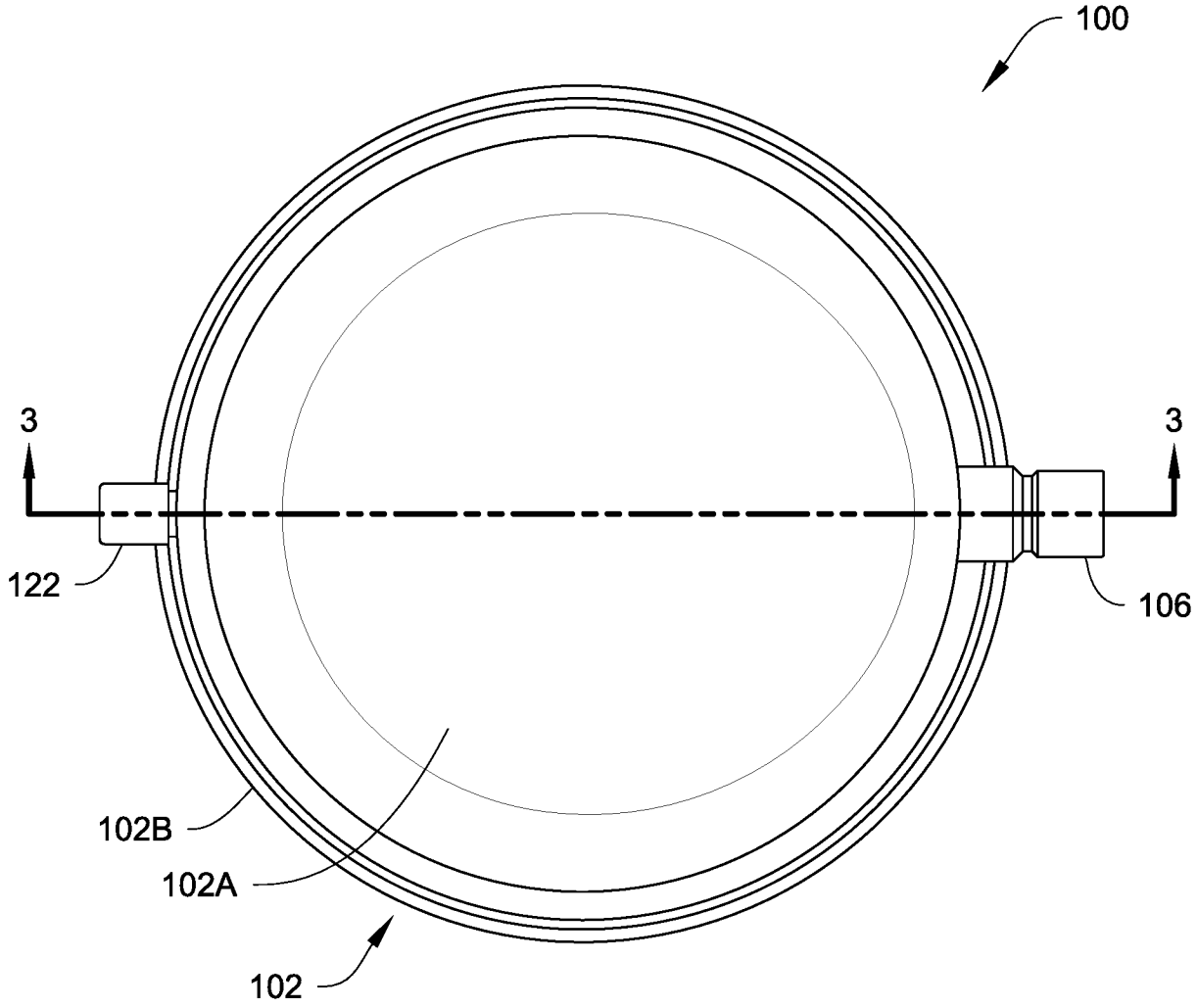
FIG. 2 is a top view of a compressor, according to an embodiment.

FIG. 2 is a top view of a compressor 100, according to an embodiment. In an embodiment, the compressor 100 can be the compressor 10 employed in the refrigerant circuit 1 of FIG. 1. It is to be appreciated that the compressor 100 can also be used for purposes other than in a refrigerant circuit. For example, the compressor 100 can be used to compress air, gases, other working fluids, or fluids other than a heat transfer fluid (e.g., natural gas, oxygen, etc.). It is to be appreciated that the compressor 100 can include additional features that are not described in detail in this Specification. For example, the compressor 100 can include a lubricant sump for storing lubricant to be introduced to the moving features of the compressor 100. As shown in FIG. 2, the compressor 100 includes a compressor housing 102, an intermediate pressure fluid inlet 122, and a compressor outlet 106.

The illustrated compressor 100 is a single-stage scroll compressor. More specifically, the illustrated compressor 100 is a single-stage vertical scroll compressor. It is to be appreciated that the principles described herein are not intended to be limited to single-stage scroll compressors and that they can be applied to multi-stage scroll compressors having two or more compression stages. Generally, the embodiments as disclosed in this Specification are suitable for a compressor with a vertical or a near vertical crankshaft (not shown in FIG. 2, see FIG. 3). It is to be appreciated that the embodiments may also be applied to a horizontally oriented compressor with a horizontal crankshaft.

As shown in FIG. 2, the compressor 100 includes a compressor housing 102, an intermediate pressure fluid inlet 122, and a compressor outlet 106. The compressor housing 102 includes a lower portion (shown in FIG. 3), a first intermediate cap (shown in FIG. 3), a second intermediate cap 102B, and an upper portion 102A. The compressor housing 102 contains components of the compressor 100, such as scroll members, shaft, compression chambers, and the like.

Figure 3:
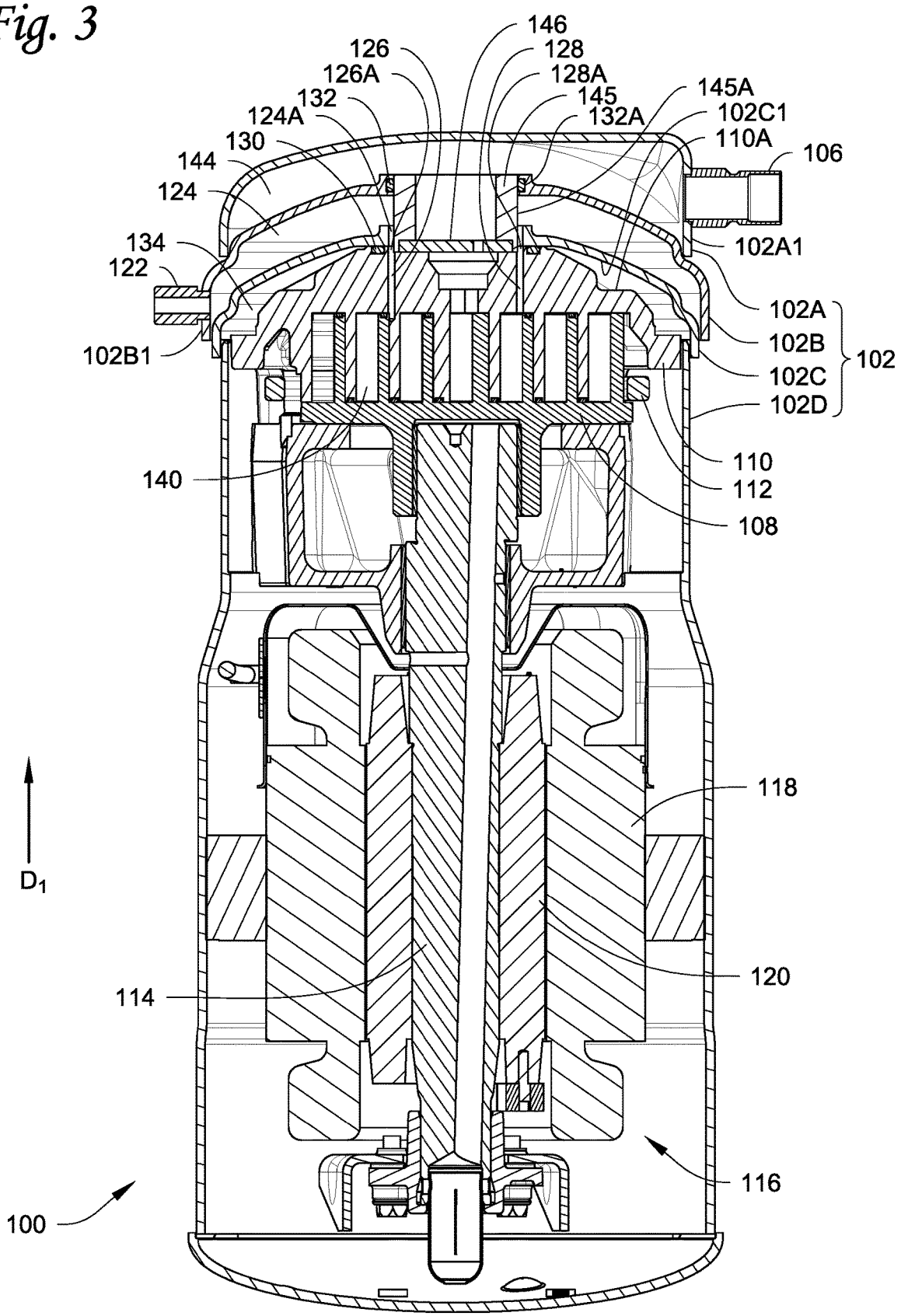
FIG. 3 is a sectional view of the compressor in FIG. 2 along the line 3-3, according to an embodiment.

FIG. 3 is a sectional view of a compressor 100 along the line 3-3 as shown in FIG. 2, according to an embodiment. The illustrated compressor 100 is a single-stage scroll compressor. More specifically, the illustrated compressor 100 is a single-stage vertical scroll compressor. It is to be appreciated that the principles described in this Specification are not intended to be limited to single-stage scroll compressors and that they can be applied to multi-stage scroll compressors having two or more compression stages. Generally, the embodiments as disclosed in this Specification are suitable for a compressor with a vertical or a near vertical crankshaft (e.g., crankshaft 114). It is to be appreciated that the embodiments may also be applied to a horizontal compressor.

The compressor outlet 106 connects a discharge pressure chamber 144 in the compressor 100 with conduits to discharge the relatively high pressure fluid from the compressor 100. In an embodiment, the compressor outlet 106 is disposed on a sidewall 102A1 of the upper portion 102A of the compressor housing 102 so that the relatively high pressure fluid from the compressor can be discharged from the side of the compressor 10. In certain applications where the space containing and servicing the compressor is limited, discharging from the side of the compressor 100 can be preferable.

The intermediate pressure fluid inlet 122 connects an intermediate pressure chamber 124 in the compressor 100 with a conduit to receive an intermediate pressure fluid, such as receiving the intermediate pressure fluid directed through the refrigerant line 28 in FIG. 1. In an embodiment, the intermediate pressure fluid inlet 122 is disposed on a sidewall 102B1 of the second intermediate cap 102B of the compressor housing 102 so that the intermediate pressure fluid can be received from the side of the compressor 10. In certain applications where the space containing and servicing the compressor is limited, receiving fluid from the side of the compressor 100 can be preferable.

The intermediate pressure fluid inlet 122 and the compressor outlet 106 are illustrated to be on the opposite sides of the compressor 100 in FIG. 3. It should be appreciated that in other embodiments the intermediate pressure fluid inlet 122 and the compressor outlet 106 may be provided in a different relative location. For example, the intermediate pressure fluid inlet 122 and the compressor outlet 106 in an embodiment may be provided on the same side of the compressor 100.

As shown in FIG. 3, the compressor 100 includes the driveshaft 114. The driveshaft 114 can alternatively be referred to as the crankshaft 114. The driveshaft 114 can be rotated by, for example, an electric motor 116. The electric motor 116 can include a stator 118 and a rotor 120. The driveshaft 114 is fixed to the rotor 120 such that the driveshaft 114 rotates along with the rotation of the rotor 120. The electric motor 116, stator 118, and rotor 120 operate according to generally known principles. The driveshaft 114 can, for example, be fixed to the rotor 120 via an interference fit or the like. The driveshaft 114 can, in an embodiment, be connected to an external electric motor, an internal combustion engine (e.g., a diesel engine or a gasoline engine), or the like. It will be appreciated that in such embodiments the electric motor 116, stator 118, and rotor 120 would not be present inside the compressor 100.

The compressor 100 can include the compressor housing 102 having an upper portion 102A, a second intermediate cap 102B, a first intermediate cap 102C, and a lower portion 102D. The upper portion 102A and the lower portion 102D of the compressor housing 102 are an outermost housing of the compressor 100. The second intermediate cap 102B and the first intermediate cap 102C of the compressor housing 102 is disposed between a compression chamber 140 and the upper portion 102A of the compressor housing 102. For example, the second intermediate cap 102B and the first intermediate cap 102C are disposed between the compression chamber 140 and the upper portion 102A in an axial direction Di of the compressor 100. The lower portion 102D provides the remainder of the compressor housing 102 for the compressor 100. In an embodiment, any two or more of the lower portion 102D, the compression chamber 140, the first intermediate cap 102C, the intermediate chamber 124, the second intermediate cap 102B, the discharge pressure chamber 144, or the upper portion 102A are stacked in an axial direction Di of the compressor 100.

The compressor 100 includes an orbiting scroll member 108 and a non-orbiting scroll member 110. The non-orbiting scroll member 110 can alternatively be referred to as, for example, the non-orbiting scroll member, the stationary scroll, or the fixed scroll. The non-orbiting scroll member 110 is in meshing engagement with the orbiting scroll member 108. For example, scrolls of the non-orbiting scroll member 110 and the orbiting scroll member 108 can be aligned to intermesh using an Oldham coupling 112. The intermeshing of the non-orbiting scroll member 110 and the orbiting scroll member 108 creates a compression chamber 140 that compresses a fluid from a relatively low pressure, such as a suction pressure, to a relatively high pressure, such as a discharge pressure. For example, the compression chamber 140 includes the plurality of pockets formed by the intermeshed scrolls. Each pocket has a range of operable refrigerant pressure less than a compressor discharge pressure at a compressor discharge. Operating according to the known principles for scroll compressors, the orbiting of the orbiting scroll moves and shrinks each pocket which compresses the fluid contained in each pocket.

In an embodiment, the compression chamber 140 discharges the fluid at the relatively high pressure from the center of the non-orbiting scroll member 110 as viewed from the top of the scroll compressor 100 (for example, viewing from the direction shown in FIG. 2). The center of the non-orbiting scroll member 110 connects to a compression chamber discharge port 145. In an embodiment, a valve plate 146 can be disposed within the compression chamber discharge port 145. In an embodiment, the valve plate 146 is affixed to the non-orbiting scroll member 110 and has a pressure activated valve configured so that the fluid discharged from the compression chamber 140 to the discharge pressure chamber 144 is at least at a predetermined pressure. In an embodiment, the compression chamber discharge port 145 can have a tubular structure with an outer sidewall 145A having a cylindrical surface. The compressor chamber discharge port 145 directs the compressed fluid discharged from the non-orbiting scroll member 110 to the discharge pressure chamber 144.

The discharge pressure chamber 144 is formed by a volume between the second intermediate cap 102B and the upper portion 102A. The discharge pressure chamber 144 defined by the intermediate cap 102B and the upper portion 102A of the housing 102. The discharge pressure chamber 144 fluidly connects the compression chamber discharge port 145 to the compressor outlet 106. The discharge pressure chamber 144 holds the fluid at the relatively high pressure discharged from the compression chamber 140 via the compression chamber discharge port 145 and provides the fluid to subsequent operations via the compressor outlet 106. For example, the subsequent operations can be a condenser.

The intermediate pressure chamber 124 is formed by a volume between the first intermediate cap 102C, the second intermediate cap 102B and the compression chamber discharge port 145. In an embodiment, the intermediate pressure chamber 124 is defined by the first intermediate cap 102C, the second intermediate cap 102B, and the compression chamber discharge port 145. In an embodiment, the intermediate pressure chamber 124 is formed by a volume between the first intermediate cap 102C, the second intermediate cap 102B and the outer sidewall 145A of the compression chamber discharge port 145. The intermediate pressure chamber 124 fluidly connects the intermediate pressure fluid inlet 122 to the one or more intermediate pressure fluid injection ports 126, 128. The intermediate pressure chamber 124 directs the intermediate pressure received through the intermediate pressure fluid inlet 122 into compression chamber 140 via the one or more intermediate pressure fluid injection ports 126, 128.

In one embodiment, the intermediate pressure fluid in the intermediate pressure chamber 124 passes through a gap 124A. The gap 124A is positioned between the first intermediate cap 102C and the outer wall 145A of the compression chamber discharge port 145. The gap 124A connects the intermediate pressure chamber 124 to fluidly connect to the one or more inlet ends 126A, 128A of the one or more intermediate pressure fluid injection ports 126, 128 in the non-orbiting scroll member 110. The gap 124A can have a variety of shapes and sizes to connect the intermediate pressure chamber 124 and an inlet end of the one or more intermediate pressure fluid injection ports 126, 128. In an embodiment, the gap 124A can have a ring shape that surrounds the outer wall 145A of the compression chamber discharge port 145. In another embodiment, the gap 124A can include one or more holes formed in the first intermediate cap 102C (e.g., by drilling or casting) that matches (e.g., aligns with) an inlet end 126A, 128A of the one or more intermediate pressure fluid injection ports 126, 128.

In the illustrated embodiment, the upper portion 102A and the second intermediate cap 102B each has a shape resembling a dome and a sidewall surrounding a bottom lip of the dome. The sidewall extending from the bottom lip of the dome. In an embodiment, the sidewall can be, for example, a sidewall 102A1 and a sidewall 102B1. The second intermediate cap 102B and the first intermediate cap 102C each further includes a center hole as viewed from the top of the compressor 100 (for example, viewing from the direction of FIG. 2). For example, the compression chamber discharge port 145 extends through the center hole in each of the second intermediate cap 102B and the first intermediate cap 102C.

In the illustrated embodiment, the compressor outlet 106 is positioned on the sidewall 102A1 of the upper portion 102A and oriented perpendicular to the driveshaft 114 of the compressor 100. In the illustrated embodiment, the compressor outlet 106 is therefore oriented such that fluid is discharged horizontally (with respect to the page). For example, the compressor outlet 106 extends from the compressor housing 102 in a direction perpendicular or about perpendicular to the axial direction Di of the compressor 100. It is to be appreciated that the compressor outlet 106 can be angled in other embodiments. For example, the angle can be less than 60 degrees relative to the axial direction Di.

The compressor 100 includes an intermediate pressure fluid inlet 122. The intermediate pressure fluid inlet 122 is disposed on the sidewall 102B1 of the second intermediate cap 102B of the compressor housing 102. In the illustrated embodiment, the intermediate pressure fluid inlet 122 is therefore oriented such that the intermediate pressure fluid is received horizontally (with respect to the page). It is to be appreciated that the intermediate pressure fluid inlet 122 can be angled in other embodiments. For example, the angle can be less than 60 degrees relative to the axial direction Di.

In an embodiment, the intermediate pressure fluid inlet 122 and the compressor outlet 106 can be, for example, machined connections or tubes that are welded to the compressor housing 102. In an embodiment, any one or more of the compressor housing 102, the intermediate pressure fluid inlet 122, and the compressor outlet 106 can be manufactured as a single piece.

The intermediate pressure fluid inlet 122 is in fluid communication with an intermediate pressure chamber 124. The intermediate pressure chamber 124 is fluidly connected to compression chamber 140 via one or more intermediate pressure fluid injection ports 126, 128. While FIG. 3 illustrates two intermediate pressure fluid injection ports 126, 128 in the non-orbiting scroll member 110, the non-orbiting scroll member 110 in other embodiments may have a different number of intermediate pressure fluid injection ports (e.g., one, more than two, or the like).

The intermediate pressure fluid injection ports 126, 128 are formed in the non-orbiting scroll member 110 of the compressor 10. Working fluid that has been compressed in the compression chamber 140 is discharged from the compressor 100 via the compressor outlet 106. The compressed working fluid (e.g., at a discharge pressure) is then provided to subsequent operations, such as the condenser (e.g., the condenser 14 via the refrigerant line 20 in FIG. 1).

A discharge seal 132 (e.g., a gasket, an O-ring, or the like) and an intermediate seal 130 (e.g., a gasket, an O-ring, a face seal, or the like) can function to fluidly isolate the intermediate pressure chamber 124 from the discharge pressure chamber 144 (e.g., fluid at a discharge pressure) and from the suction chamber 134 (e.g., fluid at a suction pressure) within the compressor 100.

The discharge seal 132 can be a radial seal that sealingly engages the second intermediate cap 102B of the compressor housing 102 and the compression chamber discharge port 145. The discharge seal 132 is configured to provide a sealing between the discharge pressure chamber 144 and the intermediate pressure chamber 124. The sealing provided by the discharge seal 132 prevents the higher pressure fluid in the discharge chamber 144 from flowing into the intermediate pressure chamber 124 that is at a relatively lower pressure (e.g., the intermediate pressure). In an embodiment, the discharge seal 132 can be a radial seal that sealingly engages a sealing surface 132A on the center hole of the second intermediate cap 102B and the outer sidewall 145A of the compression chamber discharge port 145. For example, the discharge seal 132 is compressed between the sealing surface 132A of the second intermediate cap 102B and the outer sidewall 145A of the compression chamber discharge port 145.

The intermediate seal 130 can be a face seal that sealingly engages the first intermediate cap 102C of the compressor housing 102 and the non-orbiting scroll member 110. The intermediate seal 130 provides sealing between the intermediate pressure chamber 124 and the suction chamber 134. The sealing provided by the intermediate seal 130 prevents the intermediate pressure fluid flowing from the intermediate pressure chamber 124 to the intermediate pressure fluid injection ports 126, 128 (e.g., the intermediate pressure fluid in the gap 126A) from flowing into the suction chamber 134 that is at a relatively lower pressure (e.g., suction pressure). In an embodiment, the intermediate seal 130 can be a face seal that sealingly engages a lower surface 102C1 of the first intermediate cap 102C and an upper surface 110A of the non-orbiting scroll member 110. For example, the intermediate seal 130 is compressed between the lower surface 102C1 of the first intermediate cap 102C and an upper surface 110A of the non-orbiting scroll member 110.

During manufacturing of a compressor, a radial seal can be installed without fixturing for a clearance between the two sealing surfaces. However, a face seal may require fixturing so that a proper clearance between the two sealing surfaces can be maintained. By including a second intermediate cap 102B in the compressor housing 102, an intermediate pressure chamber 124 can be formed by the first intermediate cap 102C, the second intermediate cap 102B, and the compression chamber discharge port 145. Further, a discharge pressure chamber 144 can also be formed by the upper portion 102A and the second intermediate cap 102B. As the result, the compressor outlet 106 can be disposed on the side of the compressor 100, rather than on the top of the compressor 100. A side outlet can be preferred when the space, such as the height, containing the compressor is limited. Further, by having the second intermediate cap 102B sealing around the compression chamber discharge port 145, at least one of the face seal on the non-orbiting scroll member 110 can be removed. For example, the sealing function of the removed face seal can be accomplished by a radial seal 132 positioned between the second intermediate cap 102B against an outer sidewall 145A of the compression chamber discharge port 145. A face seal is installed between two faces with a predetermined clearance therebetween, such as between an upper surface 110A of the non-orbiting scroll member 110 and a lower surface of an upper cap of the compressor housing. For example, this upper cap can be the second intermediate cap 102C in an embodiment. In manufacturing, the non-orbiting scroll member and the upper cap are fixtured to maintain this required clearance. By eliminating one face seal, at least one fixturing step can be removed from the manufacturing process, reducing the manufacturing complexity of the compressor.

In operation, the compressor 100 can receive an intermediate pressure fluid via the intermediate pressure fluid inlet 122 and provide that fluid to the compression chamber 140 via the intermediate pressure fluid injection ports 126, 128, where the fluid is compressed and ultimately discharged via the compressor outlet 106. In an embodiment, the fluid can be a refrigerant at a pressure lower than the discharge pressure and higher than the suction pressure, being in a liquid phase, a vapor phase, or a combination thereof. The intermediate pressure fluid mixes with the partially compressed fluid in a pocket of the compression chamber 140, and the mixture is then further compressed until it reaches the point at which it is discharged from between the intermeshed scroll members 108, 110.

In an embodiment, to ensure that working fluid is flowing into the compression chamber 140 via the intermediate pressure fluid injection ports 126, 128, and not outward, the pressure of the working fluid at the intermediate pressure fluid injection ports 126, 128 may generally be higher than the pressure of the working fluid in the compression chamber 140 at which the working fluid is being injected. In an embodiment, because pressure of the compression chamber 140 is cyclic in a scroll compressor, the pressure of the compression chamber 140 at the location of the intermediate pressure fluid injection ports 126, 128 may briefly be less than the pressure of the working fluid at the intermediate pressure fluid injection ports 126, 128. However, the intermediate pressure chamber 124 can reduce an impact of back pressure that could flow backwards into the intermediate pressure chamber 124. In an embodiment, a one-way flow control device, such as a check valve, could be included upstream from the intermediate pressure fluid injection ports 126, 128 to limit the fluid flowing backwards from the normal flow direction.

Figure 4:
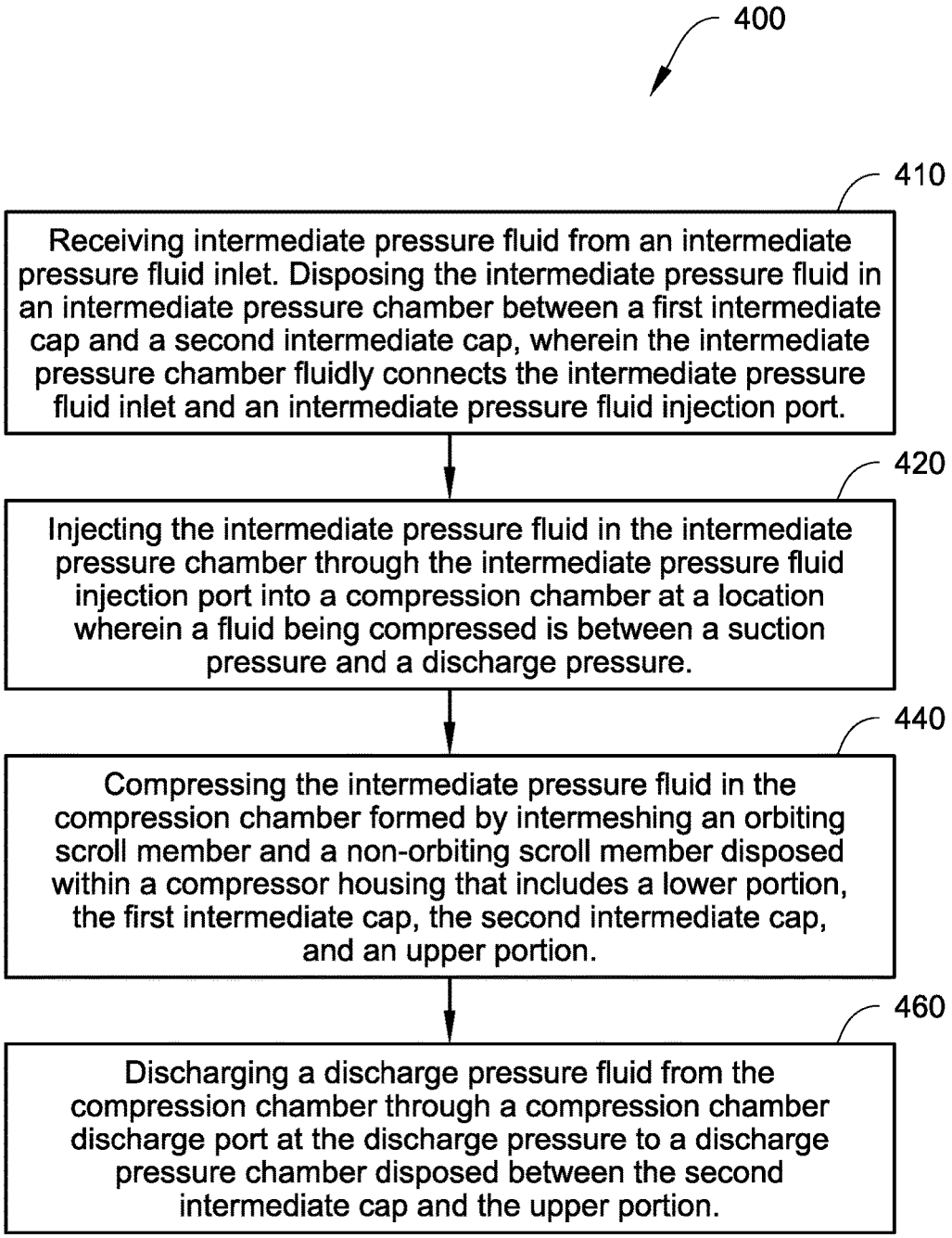
FIG. 4 is a flow chart for a method of injecting an intermediate pressure fluid, according to an embodiment.

FIG. 4 is a flowchart of a method 400 for injecting an intermediate pressure fluid, according to an embodiment. In an embodiment, the method 40 may be employed by the compressor 100 in the refrigerant circuit 1. The method 400 starts at 410.

At 410, the compressor 100 can receive the intermediate pressure fluid by an intermediate pressure fluid inlet (e.g., the intermediate pressure fluid inlet 122 of FIG. 3). The intermediate fluid is disposed in an intermediate pressure chamber (e.g., the intermediate pressure chamber 124 of FIG. 3) between a first intermediate cap (e.g., the first intermediate cap 102C of FIG. 3) and a second intermediate cap (e.g., the second intermediate cap 102B of FIG. 3). The intermediate pressure chamber fluidly connects the intermediate pressure fluid inlet to an intermediate pressure fluid injection port (e.g., the intermediate pressure fluid injection port 126, 128 of FIG. 3). The method 400 then proceeds to 420.

At 420, the fluid at an intermediate pressure in the *intermedia* pressure chamber (e.g., the intermediate pressure chamber 124 of FIG. 3) is injected through the intermediate pressure fluid injection port into a compression chamber (e.g., the compression chamber 140). The outlet of intermediate pressure fluid injection portion is positioned such that the fluid is injected into the compression chamber at a location wherein a fluid being compressed is between a suction pressure and a discharge pressure. The method 400 then proceeds to 440.

At 440, the fluid at the intermediate pressure is compressed in the compression chamber from an intermediate pressure to a discharge pressure. For example, the injected fluid mixes with the fluid already within the compression chamber 440, and the mixture is further compressed to the discharge pressure. The method 400 then proceeds to 460.

At 460, the further compressed fluid is discharged from the compression chamber through a compression chamber discharge port (e.g., the compression chamber discharge port 145) to a discharge pressure chamber (e.g., the discharge pressure chamber 144 of FIG. 3). The further compressed fluid discharged from the compression chamber at the discharge pressure. The discharge pressure chamber disposed between the second intermediate cap and the upper portion.

Aspects

It is noted that any of aspects 1-10 can be combined with any one of aspects 11-19.

Aspect 1. A scroll compressor, comprising: a compressor housing including a lower portion, a first intermediate cap, a second intermediate cap, and an upper portion; an orbiting scroll member and a non-orbiting scroll member disposed within the compressor housing and intermeshing forming a compression chamber; a discharge pressure chamber disposed between the second intermediate cap and the upper portion configured to receive a discharge pressure fluid from the compression chamber through a compression chamber discharge port; an intermediate pressure chamber disposed between the first intermediate cap and the second intermediate cap fluidly connecting an intermediate pressure fluid inlet and an intermediate pressure fluid injection port of the non-orbiting scroll member; and a face seal disposed between an upper surface of the non-orbiting scroll member and a lower surface of the first intermediate cap.

Aspect 2. The compressor of aspect 1, further comprising: a radial seal disposed between an inner radial wall of the second intermediate cap and an outer sidewall of the compression chamber discharge port.

Aspect 3. The compressor of any one of aspects 1-2, wherein a seal is formed between the intermediate pressure chamber and the discharge pressure chamber without a face seal.

Aspect 4. The compressor of any one of aspects 1-3, wherein the second intermediate cap radially extends from an outer sidewall of the compression chamber discharge port and attaches to an outer sidewall of the first intermediate cap.

Aspect 5. The compressor of any one of aspects 1-4, wherein the intermediate pressure fluid inlet is disposed on a sidewall of the second intermediate cap and is configured to receive an intermediate pressure fluid into the intermediate pressure chamber.

Aspect 6. The compressor of any one of aspects 1-5, further comprising: a compressor outlet disposed on a sidewall of the upper portion.

Aspect 7. The compressor of any one of aspects 1-6, wherein the intermediate pressure fluid injection port is disposed in the non-orbiting scroll member and is configured to inject an intermediate pressure fluid from the intermediate pressure chamber into the compression chamber.

Aspect 8. The compressor of any one of aspects 1-7, wherein the intermediate pressure fluid injection port is configured to fluidly connect to the compression chamber at a location wherein a fluid being compressed is between a suction pressure and a discharge pressure of the compressor.

Aspect 9. The compressor of any one of aspects 1-8, wherein the compression chamber is configured to receive a suction pressure fluid from a compressor inlet, receive an intermediate pressure fluid at an intermediate pressure, compress the suction pressure fluid and the intermediate pressure fluid to a discharge pressure providing the discharge pressure fluid, and discharge the discharge pressure fluid to the discharge pressure chamber.

Aspect 10. The compressor of any one of aspects 1-9, wherein the discharge pressure chamber fluidly connects the compression chamber discharge port to a compressor outlet.

Aspect 11. A method of injecting an intermediate pressure fluid into a compression chamber of a scroll compressor, the scroll compressor including a housing having a lower portion, a first intermediate cap, a second intermediate cap, and an upper portion, and the method comprising: receiving the intermediate pressure fluid by an intermediate pressure fluid inlet; disposing the intermediate pressure fluid in an intermediate pressure chamber between the first intermediate cap and the second intermediate cap, wherein the intermediate pressure chamber fluidly connects the intermediate pressure fluid inlet and intermediate pressure fluid injection port of the non-orbiting scroll member; injecting the intermediate pressure fluid in the intermediate pressure chamber through the intermediate pressure fluid injection port into a compression chamber at a location wherein a fluid being compressed is between a suction pressure and a discharge pressure; compressing the intermediate pressure fluid in the compression chamber to provide a discharge pressure fluid, the compression chamber formed by intermeshing an orbiting scroll member and a non-orbiting scroll member disposed within the compressor housing; and discharging the discharge pressure fluid at the discharge pressure from the compression chamber through a compression chamber discharge port to a discharge pressure chamber, the discharge pressure chamber disposed between the second intermediate cap and the upper portion of the housing.

Aspect 12. The method of aspect 11, wherein receiving the intermediate pressure fluid by the intermediate pressure fluid inlet through a sidewall of the second intermediate cap.

Aspect 13. The compressor of any one of aspects 11-12, further comprising:

discharging the discharge pressure fluid in the discharge pressure chamber through a compressor outlet disposed on a sidewall of the upper portion of the housing.

Aspect 14. The compressor of any one of aspects 11-13, wherein the discharge pressure chamber fluidly connects the compression chamber discharge port to the compressor outlet.

Aspect 15. The compressor of any one of aspects 11-14, wherein a radial seal disposed between an inner radial wall of the second intermediate cap and an outer sidewall of the compression chamber discharge port.

Aspect 16. The compressor of any one of aspects 11-15, wherein a face seal disposed between an upper surface of the non-orbiting scroll member and a lower surface of the first intermediate cap.

Aspect 17. The compressor of any one of aspects 11-16, wherein a seal is formed between the intermediate pressure chamber and the discharge pressure chamber without a face seal.

Aspect 18. The compressor of any one of aspects 11-17, wherein the second intermediate cap radially extends from an outer sidewall of the compression chamber discharge port and attaches to an outer sidewall of the first intermediate cap.

Aspect 19. The compressor of any one of aspects 11-18, wherein the intermediate pressure fluid injection port is disposed in the non-orbiting scroll member.

The terminology used in this Specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A scroll compressor, comprising:

a compressor housing including a lower portion, a first intermediate cap, a second intermediate cap, and an upper portion;

an orbiting scroll member and a non-orbiting scroll member disposed within the compressor housing and intermeshing forming a compression chamber;

a discharge pressure chamber disposed between the second intermediate cap and the upper portion and configured to receive a discharge pressure fluid from the compression chamber through a compression chamber discharge port, the compression chamber discharge port being separate from and disposed on the non-orbiting scroll member;

an intermediate pressure chamber disposed between the first intermediate cap and the second intermediate cap and fluidly connecting an intermediate pressure fluid inlet and an intermediate pressure fluid injection port of the non-orbiting scroll member;

a face seal disposed between an upper surface of the non-orbiting scroll member and a lower surface of the first intermediate cap; and a gap between the first intermediate cap and an outer sidewall of the compression chamber discharge port, wherein the gap fluidly connects the intermediate pressure chamber and the intermediate pressure fluid injection port.

2. The compressor of claim 1, further comprising:

a radial seal disposed between an inner radial wall of the second intermediate cap and the outer sidewall of the compression chamber discharge port.

3. The compressor of claim 1, wherein a seal is formed between the intermediate pressure chamber and the discharge pressure chamber without a face seal.

4. The compressor of claim 1, wherein the second intermediate cap radially extends from the outer sidewall of the compression chamber discharge port and attaches to an outer sidewall of the first intermediate cap.

5. The compressor of claim 1, wherein the intermediate pressure fluid inlet is disposed on a sidewall of the second intermediate cap and is configured to receive an intermediate pressure fluid into the intermediate pressure chamber.

6. The compressor of claim 1, further comprising:

a compressor outlet disposed on a sidewall of the upper portion.

7. The compressor of claim 1, wherein the intermediate pressure fluid injection port is disposed in the non-orbiting scroll member and is configured to inject an intermediate pressure fluid from the intermediate pressure chamber into the compression chamber.

8. The compressor of claim 1, wherein the intermediate pressure fluid injection port is configured to fluidly connect to the compression chamber at a location wherein a fluid being compressed is between a suction pressure and a discharge pressure of the compressor.

9. The compressor of claim 1, wherein the compression chamber is configured to:

receive a suction pressure fluid from a compressor inlet, receive an intermediate pressure fluid at an intermediate pressure, compress the suction pressure fluid and the intermediate pressure fluid to a discharge pressure providing the discharge pressure fluid, and discharge the discharge pressure fluid to the discharge pressure chamber.

10. The compressor of claim 1, wherein the discharge pressure chamber fluidly connects the compression chamber discharge port to a compressor outlet.

11. A method of injecting an intermediate pressure fluid into a compression chamber of a scroll compressor, the scroll compressor including a housing having a lower portion, a first intermediate cap, a second intermediate cap, and an upper portion, and the method comprising:

receiving the intermediate pressure fluid by an intermediate pressure fluid inlet;

disposing the intermediate pressure fluid in an intermediate pressure chamber between the first intermediate cap and the second intermediate cap, wherein the intermediate pressure chamber fluidly connects the intermediate pressure fluid inlet and an intermediate pressure fluid injection port of a non-orbiting scroll member;

injecting the intermediate pressure fluid in the intermediate pressure chamber through a gap into the intermediate pressure fluid injection port and into the compression chamber at a location wherein a fluid being compressed is between a suction pressure and a discharge pressure;

compressing the intermediate pressure fluid in the compression chamber to provide a discharge pressure fluid, the compression chamber formed by intermeshing an orbiting scroll member and the non-orbiting scroll member disposed within the compressor housing; and discharging the discharge pressure fluid at the discharge pressure from the compression chamber through a compression chamber discharge port to a discharge pressure chamber, the compression chamber discharge port being separate from and disposed on the non-orbiting scroll member, wherein the gap is between the first intermediate cap and an outer sidewall of the compression chamber discharge port, and the gap fluidly connects the intermediate pressure chamber and an intermediate pressure fluid injection port.

12. The method of claim 11, wherein receiving the intermediate pressure fluid by the intermediate pressure fluid inlet through a sidewall of the second intermediate cap.

13. The method of claim 11, further comprising:

discharging the discharge pressure fluid in the discharge pressure chamber through a compressor outlet disposed on a sidewall of the upper portion of the housing.

14. The method of claim 11, wherein the discharge pressure chamber fluidly connects the compression chamber discharge port to a compressor outlet.

15. The method of claim 11, wherein the scroll compressor further includes:

a radial seal disposed between an inner radial wall of the second intermediate cap and the outer sidewall of the compression chamber discharge port.

16. The method of claim 11, wherein the scroll compressor further includes:

a face seal disposed between an upper surface of the non-orbiting scroll member and a lower surface of the first intermediate cap.

17. The method of claim 11, wherein a seal is formed between the intermediate pressure chamber and the discharge pressure chamber without a face seal.

18. The method of claim 11, wherein the second intermediate cap radially extends from an outer sidewall of the compression chamber discharge port and attaches to an outer sidewall of the first intermediate cap.

19. The method of claim 11, wherein the intermediate pressure fluid injection port is disposed in the non-orbiting scroll member.

20. The compressor of claim 1, wherein the compressor chamber discharge port has a tubular structure, and the gap is defined radially between the tubular structure and the first intermediate cap.

* * * * *